US007721878B2

(12) United States Patent
Requena

(10) Patent No.: US 7,721,878 B2
(45) Date of Patent: May 25, 2010

(54) PACKAGE FOR CONTAINERS

(75) Inventor: Emili Requena, Igualada (ES)

(73) Assignee: Graphic Packaging International, Inc., Marietta, GA (US)

( * ) Notice: Subject to any disclaimer, the term of this patent is extended or adjusted under 35 U.S.C. 154(b) by 168 days.

(21) Appl. No.: 11/682,665

(22) Filed: Mar. 6, 2007

(65) Prior Publication Data

US 2008/0179202 A1 Jul. 31, 2008

(30) Foreign Application Priority Data

Jan. 25, 2007 (ES) ..... 200700203

(51) Int. Cl.
*B65D 75/02* (2006.01)

(52) U.S. Cl. ..... 206/148; 206/147; 206/152; 206/158; 206/157

(58) Field of Classification Search ..... 206/427, 206/139, 140, 145, 147–149, 152–158, 160, 206/434
See application file for complete search history.

(56) References Cited

U.S. PATENT DOCUMENTS 2,737,326 A * 3/1956 Toensmeier ..... 206/153
2,764,284 A 9/1956 Arneson
2,950,041 A * 8/1960 Stone ..... 206/147
3,245,711 A * 4/1966 Dantoin ..... 206/153
3,612,266 A 10/1971 Graser
3,767,041 A 10/1973 Graser
4,131,198 A 12/1978 Fischer
4,164,286 A 8/1979 Sutherland
4,188,766 A 2/1980 Culpepper
4,192,540 A 3/1980 Oliff
4,326,628 A * 4/1982 Wood ..... 206/427
4,336,898 A 6/1982 Joyce
4,432,579 A * 2/1984 Denmark et al. ..... 206/158
4,438,843 A 3/1984 Graser
4,489,880 A 12/1984 Calvert
4,566,591 A 1/1986 Turtschan et al.
4,703,847 A 11/1987 Oliff
5,135,104 A 8/1992 Jorba
5,188,225 A 2/1993 Jorba
5,323,895 A 6/1994 Sutherland et al.
5,351,815 A * 10/1994 Fogle et al. ..... 206/147
5,407,065 A 4/1995 Sutherland
5,439,112 A 8/1995 De Guglielmo et al.
5,445,262 A 8/1995 Sutherland (Continued)

FOREIGN PATENT DOCUMENTS

DE 196 42 571 A1 5/1997

(Continued)

OTHER PUBLICATIONS

International Search Report—PCT/US2007/084002.

(Continued)

*Primary Examiner*—J. Gregory Pickett
*Assistant Examiner*—A. P.
(74) *Attorney, Agent, or Firm*—Womble Carlyle Sandridge & Rice, PLLC

(57) ABSTRACT

A package is formed from a carton and containers extending through a bottom panel of the carton. First and second struts and a brace in the carton interior provide support for the containers accommodated within the carton.

22 Claims, 3 Drawing Sheets

U.S. PATENT DOCUMENTS

| | | | | |
|---|---|---|---|---|
| 5,484,059 | A | 1/1996 | Sutherland | |
| 5,503,267 | A | 4/1996 | Sutherland | |
| 5,598,920 | A | 2/1997 | Hansen | |
| 5,620,094 | A | 4/1997 | Naumann | |
| 5,638,956 | A * | 6/1997 | Sutherland | 206/147 |
| 5,687,838 | A | 11/1997 | Bakx | |
| 5,845,776 | A | 12/1998 | Galbierz et al. | |
| 5,921,392 | A | 7/1999 | Davis | |
| 5,957,289 | A | 9/1999 | Negelen | |
| 5,960,945 | A | 10/1999 | Sutherland | |
| 5,984,086 | A * | 11/1999 | Foushee et al. | 206/147 |
| 6,021,897 | A | 2/2000 | Sutherland | |
| 6,223,892 | B1 | 5/2001 | Bakx | |
| 6,315,111 | B1 | 11/2001 | Sutherland | |
| 6,488,322 | B2 | 12/2002 | Bakx | |
| 6,615,984 | B2 | 9/2003 | Saulas et al. | |
| 7,264,114 | B2 * | 9/2007 | Daniel | 206/157 |
| 2002/0113449 | A1 | 8/2002 | Bakx | |
| 2004/0079666 | A1 | 4/2004 | Bakx | |
| 2004/0226833 | A1 | 11/2004 | Daniel | |
| 2007/0000794 | A1 | 1/2007 | Requena | |

FOREIGN PATENT DOCUMENTS

| | | | |
|---|---|---|---|
| DE | 203 17 334 | U1 | 2/2004 |
| DE | 20 2004 004 248 | U1 | 8/2004 |
| DE | 20 2004 017 954 | U1 | 2/2005 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 541 334 | A1 | 5/1993 |
| EP | 0 780 320 | A1 | 6/1997 |
| EP | 1 070 671 | A1 | 1/2001 |
| EP | 1 384 679 | A1 | 1/2004 |
| FR | 1582235 | | 9/1969 |
| FR | 2 525 992 | | 11/1983 |
| FR | 2 664 239 | | 1/1992 |
| FR | 2 731 413 | | 9/1996 |
| GB | 1 342 180 | | 12/1973 |
| GB | 2 085 319 | A | 4/1982 |
| GB | 2 158 037 | A | 11/1985 |
| WO | WO 97/33807 | | 9/1997 |
| WO | WO 98/49071 | | 11/1998 |
| WO | WO 99/01356 | | 1/1999 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2005/095222 | A1 | 10/2005 |
| WO | WO 2006/044583 | A2 | 4/2006 |
| WO | WO 2006/108098 | A1 | 10/2006 |
| WO | WO 2007/044525 | A1 | 4/2007 |

OTHER PUBLICATIONS

Written Opinion—PCT/US2007/084002.

* cited by examiner

PACKAGE FOR CONTAINERS

BACKGROUND

Cartons for engaging and securing upper portions of containers are known. The containers are typically inserted through apertures in a bottom panel of the carton and secured by engaging radially protruding parts of the containers. One such carton is disclosed in U.S. Pat. No. 6,223,892 to Bakx. Conventional cartons, however, may not securely retain the containers, or may fail to satisfy other requirements recognized in the art.

SUMMARY

According to a first embodiment of the invention, a package comprises a carton comprising a top panel, a first receiving panel, a second receiving panel, a first side panel, a second side panel, a brace extending between the first and second receiving panels, a first row of first container apertures in the first receiving panel, and a second row of second container apertures in the second receiving panel. A plurality of containers are accommodated in the container apertures.

According to one aspect of the first embodiment, the brace abuts one or more of the containers in the carton interior to prevent pivoting and/or translation of the containers. The brace may be formed from one or more foldably connected panels that are drawn up into the carton interior during erection of the carton.

According to another aspect of the first embodiment, struts may be located at each container aperture. The struts may be arranged in pairs, and may exert an upward bias on flanges of the containers. The struts therefore prevent the containers from inadvertently falling downward through the container apertures.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to cartons for attachment to containers. The cartons engage and secure upper portions of the containers to form a package.

Figure 1:
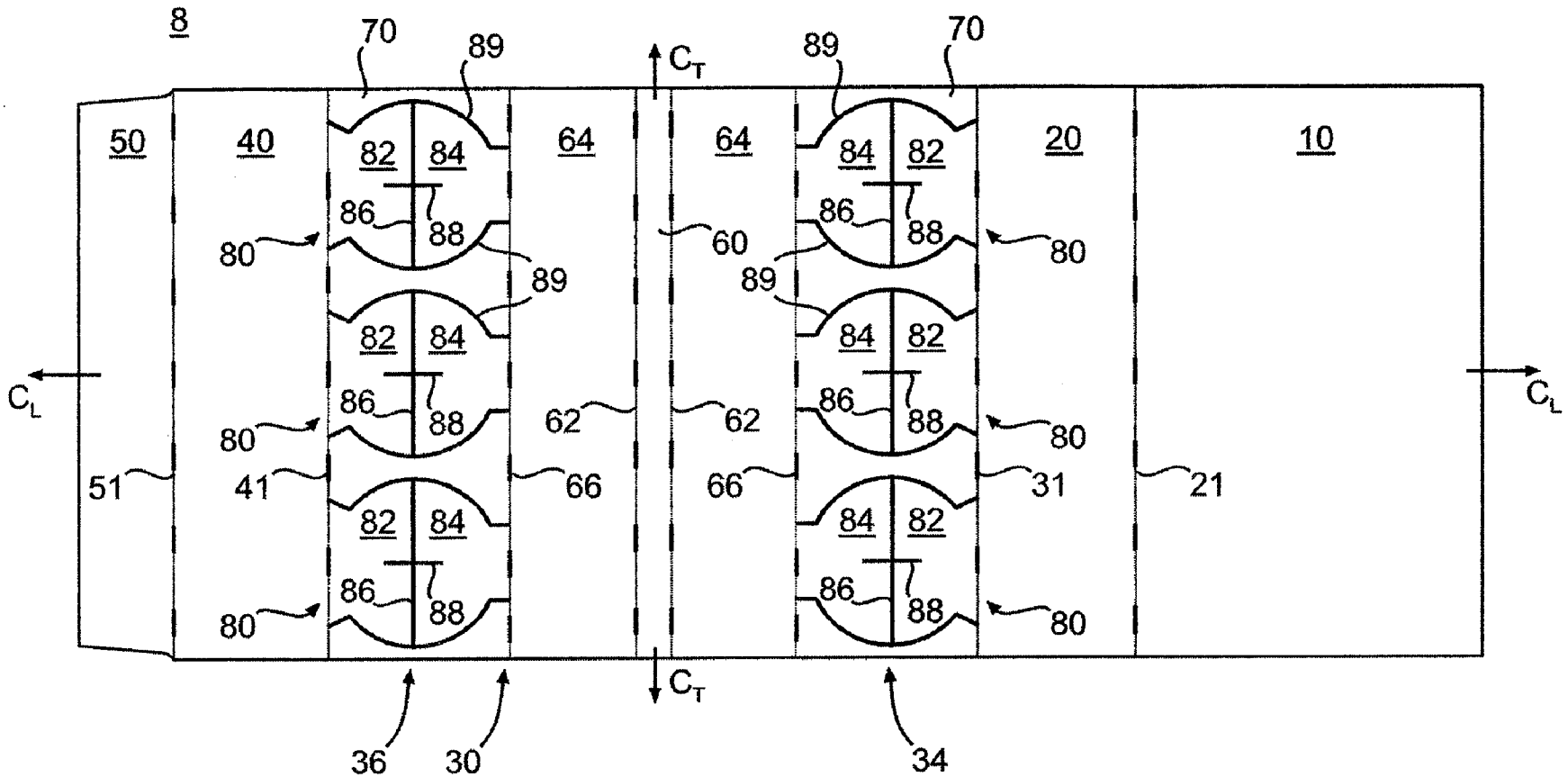
FIG. 1 is a plan view of a blank used to form a package according to a first embodiment of the invention.

FIG. 1 is a plan view of a blank 8 used to form a carton or carrier 150 according to an embodiment of the invention. The carton 150 is illustrated in its erected state in FIG. 5, in which it is attached to upper portions of containers 170, forming a package 200. As shown in FIG. 1, the blank 8 may be wholly or partially symmetric about a transverse centerline $C_T$ and a longitudinal centerline $C_L$. Therefore, certain elements in the drawing figures share common reference numerals in order to reflect the whole and/or partial symmetries. In this specification, the terms "bottom," "top," "lower," "upper," and "side" indicate orientations determined in relation to a fully erected carrier package placed in an upright configuration.

Referring to FIG. 1, the blank 8 comprises a first top panel 10 foldably connected to a first side panel 20 at a first transverse fold line 21, a bottom panel 30 foldably connected to the first side panel 20 at a second transverse fold line 31, a second side panel 40 foldably connected to the bottom panel 30 at a third transverse fold line 41, and a second top panel 50 foldably connected to the second side panel 40 at a fourth transverse fold line 51.

The bottom panel 30 includes six container-receiving patterns 80. Three patterns 80 are arranged in a first row 34 and three patterns 80 are arranged in a second row 36 in the bottom panel 30. Each container-receiving pattern 80 is shaped and sized to receive an upper portion of a container 170 that is to be held within the erected carton 150. In the exemplary embodiment, six containers 170 are accommodated in the erected carton 150, forming a 2×3 package. Other package configurations, such as 2×2 or 2×4, etc. are also within the scope of the present invention.

Each first container-receiving pattern 80 includes a plurality of lines of disruption defining an outer strut 82 and an inner strut 84. In each pattern 80, the outer and inner struts 82, 84 are separated by a transverse cut 86, and a longitudinal expansion cut 88 extends through a center portion of adjacent outer and inner struts 82, 84. The sides of the struts 82, 84 are defined by side cuts 89. The side cuts 89 may include curved or arcuate sections that may conform to the exterior profile of the containers C. In the first row 34, the outer struts 82 are foldably attached at the transverse fold line 31, and the inner struts 84 are foldably attached at a transverse fold line 66. In the second row 36, the outer struts 82 are foldably attached at the transverse fold line 41, and the inner struts 84 are foldably attached at a transverse fold line 66.

The bottom panel 30 is divided into a plurality of generally rectangular elongate panels 60, 64, 70. The container-receiving patterns 80 in the first row 34 are formed in a first receiving panel 70 foldably connected to the first side panel 20 at the fold line 31. The container-receiving patterns 80 in the second row 36 are formed in a second receiving panel 70 foldably connected to the second side panel 40 at the fold line 41. A side brace panel 64 is foldably connected to an interior side of each receiving panel 70 at a transverse fold line 66. A center brace panel 60 is foldably connected to an interior side of each side brace panel 64 at a transverse fold line 62. The brace panels 60, 64 are foldable with respect to one another to form a brace in the erected carton 150.

The transverse fold lines 21, 31, 41, 51, 62, 66 in the blank 8 can be more generally referred to as "lines of weakness" or "lines of disruption" in the blank about which the blank is foldable to some degree. Each of the fold lines may be interrupted at one or more locations, for example, and need not be continuous across its entire length. One or more cuts may be, for example, placed along one or more of the transverse fold lines 21, 31, 41, 51, 62, 66. Any number of cuts may be formed along the fold lines, and the number and length of the cuts may be selected according to, for example, the gauge and the stiffness of the material used to form the blank 8. The cuts may be partial cuts (e.g. kiss cuts), or 100% cuts extending through the entire thickness of the blank 8.

The lines 86, 88, 89 defining the container-receiving patterns 80 are illustrated as continuous 100% cuts (e.g. slits) which extend through the entire thickness of the blank 8. The lines 86, 88, 89 can be generally referred to as "breachable lines of disruption" that are intended to be breached during erection of the carton 150. The breachable lines can be, for example, continuous or substantially continuous tear lines formed by, for example, scores, creases, cuts, gaps, cut/creases, perforations, offset cuts, and combinations thereof. If cuts are used to form the breachable lines 86, 88, 89, the cuts may be, for example, interrupted by breachable nicks. Partial cuts, which do not extend through the entire thickness of the blank 8, for example, may also be used.

An exemplary method of erection of the carton 150 to form the package 200 is discussed below with reference to FIGS. 2-5.

Figure 2:
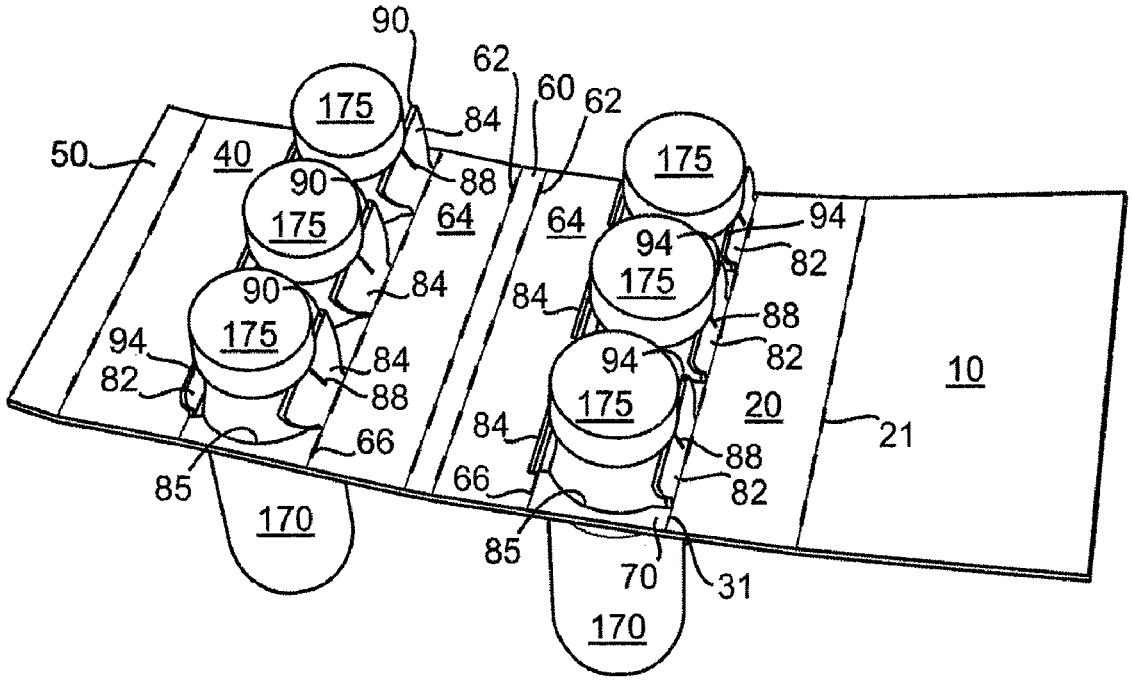
FIG. 2 illustrates an erection step for forming the first package embodiment.

FIG. 2 is a perspective view of an erection step of the carton 150 including its initial attachment to the containers 170. Top portions of four containers 170, including their flanges 175, are inserted through the container-receiving patterns 80, one container 170 per pattern 80. Insertion of the containers 170 may serve to open up container apertures 85 in the receiving panels 70. The container apertures 85 may, for example, have curved or arcuate sidewalls at each end that may generally conform in shape to the exterior profiles of the containers 170. In FIG. 2, the containers 170 push the outer and inner struts 82, 84 upwardly so that they fold about the transverse fold lines 66, 31 or 41, and extend generally upwardly from the receiving panels 70. After insertion in the container-receiving patterns 80, the underside of each container flange 175 rests on an upper edge 94 of an adjacent outer strut 82, and an upper edge 90 of an adjacent inner strut 84. The outer and inner struts 82, 84 can deform at the expansion cuts 88 as the struts deform around the curved upper portions of the containers 170.

Figure 3:
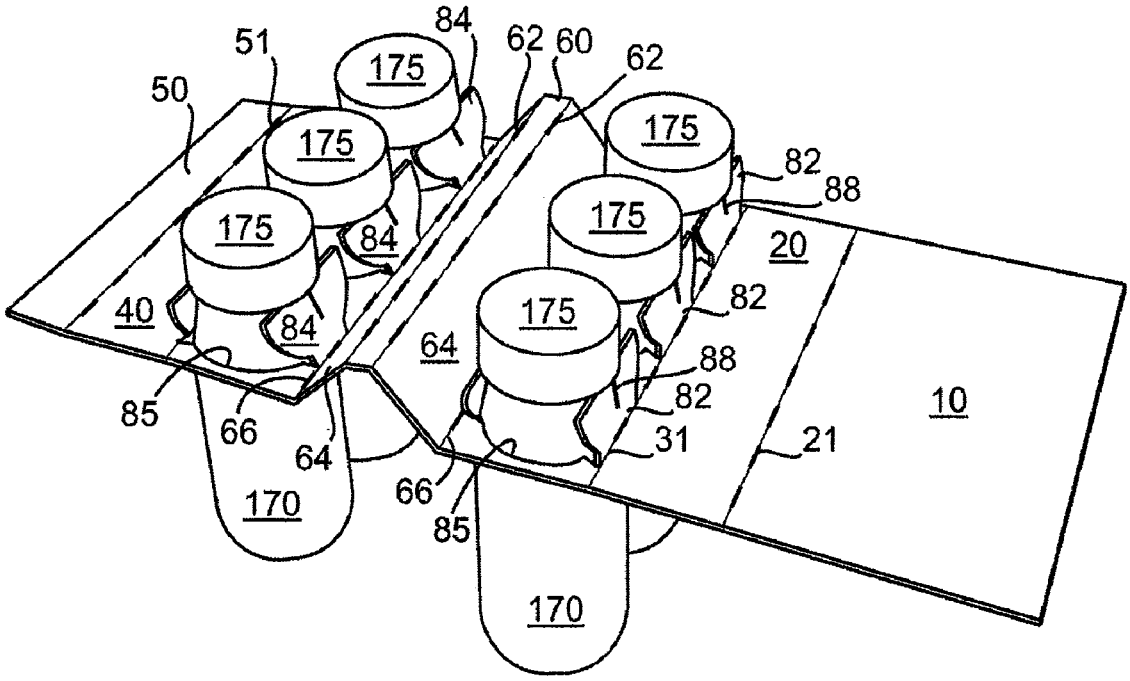
FIG. 3 illustrates an erection step for forming the first package embodiment.

Referring to FIG. 3, the side brace panels 64 are pivoted upwardly about the transverse fold lines 62, 66 as the sides of the blank 8 are drawn inwardly. The center brace panel 60 folds with respect to the side brace panels 64 at the fold lines 62.

Figure 4:
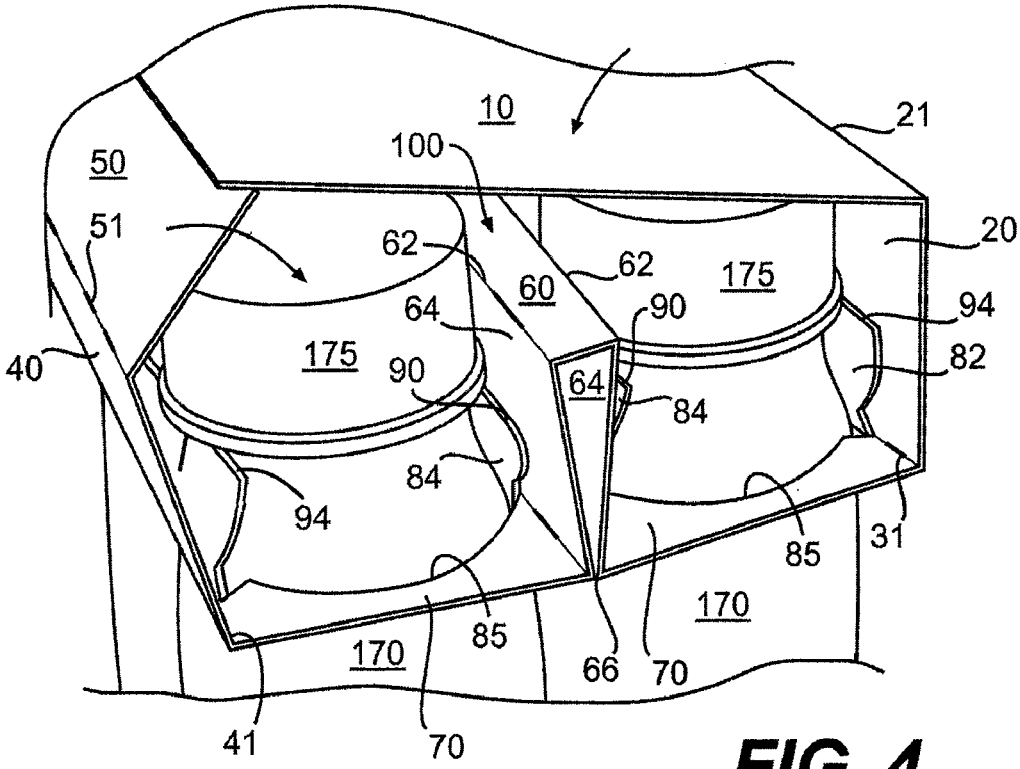
FIG. 4 illustrates an erection step for forming the first package embodiment.
Figure 5:
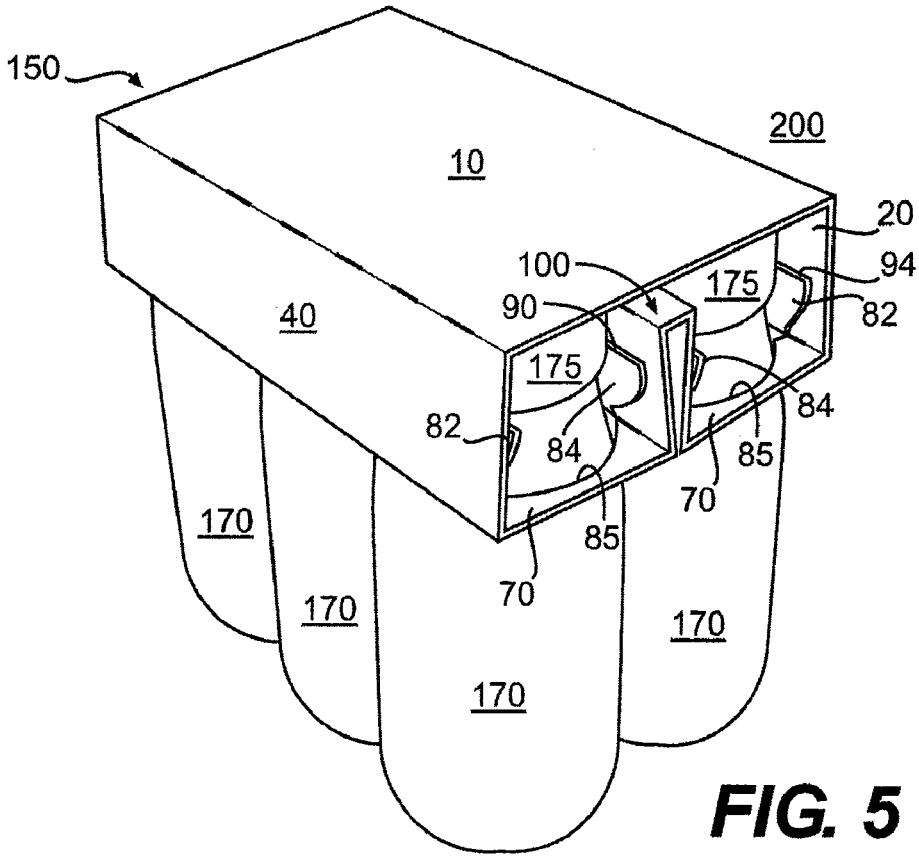
FIG. 5 illustrates the first package embodiment.

Referring to FIG. 4, the side brace panels 64 are further pivoted upwardly about the transverse fold lines 66 as the sides of the blank 8 are drawn inwardly until the side brace panels 64 abut. The center portion of the blank 8 is thereby drawn upwardly into the interior of the carton 150 until the receiving panels 70 are adjacent or abutting one another. If desired, the side brace panels 64 may optionally be adhered together in the vicinity of the fold lines 66 where the side brace panels 64 abut. As the side brace panels 64 pivot upwardly and out of plane with the panels 70, the center brace panel 60 moves upwardly until it abuts interior surfaces of the container flanges 175. In this configuration, the side brace panels 64 and the center brace panel 60 form a brace 100. The first and second side panels 20, 40 are pivoted inwardly about the transverse fold lines 31, 41 respectively, so that they extend generally upright. The second top panel 50 is folded about the transverse fold line 51 so that it extends over the tops of the containers 170 disposed within the second row 36 (FIG. 1) of container apertures 85. The first top panel 10 is then folded over the tops of the containers 170 disposed within the second row 34 of container apertures 85 and the underside of the top panel 10 is adhered to the upper side of the second top panel 50. FIG. 5 illustrates the carton 150 secured around the top portions of the containers 170, forming a package 200.

As shown in FIGS. 4 and 5, the carton 150 is a generally tubular form with open ends. When viewed from the open ends of the carton 150, the cross section of the carton 150 is generally rectangular, although the upright side panels 20, 40 can be tilted with respect to vertical so that the cross section is generally trapezoidal. The brace 100 extends through the center of the carton 150 and abuts interior surfaces of the container flanges 175. When viewed from the open ends of the carton 150, the brace 100 has a generally triangular cross section, with the center brace panel 60 extending across the top of the brace 100. The center brace panel 60 exerts a bias against the inner surfaces of the flanges 175 and the side panels 20, 40 exert a bias on the outer surface of the flanges 175. The opposing biases on the container flanges 175 are arranged to prevent the containers 170 from pivoting and/or otherwise translating within the carton 150. The outer and inner struts 82, 84 exert upward biases on the undersides of the flanges 175 that prevent the containers 170 from inadvertently falling downwardly through the receiving apertures 85. The outer and inner struts 82, 84 also further restrict pivoting and/or other translation of the containers 170 within the carton 150.

According to one aspect of the above embodiment, containers 170 are securely retained by the side panels 20, 40, the struts 82, 84 and by the brace 100 in the carton interior. The containers 170 are thereby secured against being pulled downwardly through the receiving panels 70, and are also secured against excessive translation and/or pivoting within the carton 150.

The exemplary embodiment shown in FIG. 5 illustrates a carton 150 accommodating six containers 170 arranged in two rows and three columns. Additional columns, for example, may be added by increasing the width of the blank 8 (in the transverse direction in FIG. 1) and forming additional columns of container-receiving patterns 80 in the bottom panel 30.

In this specification, the term "flange" indicates any radially projecting rim, collar, ring, raised portion or protrusion extending from an upper portion of a container. The present embodiments illustrate containers having lids disposed on a bottom, receptacle portion. The term "flange" can apply to a radially projecting upper portion of the receptacle and/or to a container lid secured to the top of the receptacle portion.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect information printed on the blank. The blank may also be coated with, for example, a moisture barrier layer, on either or both sides of the blank.

In accordance with the exemplary embodiments, the blank may be constructed of paperboard of a caliper such that it is heavier and more rigid than ordinary paper. The blank can also be constructed of other materials, such as cardboard, hard paper, or any other material having properties suitable for enabling the carrier package to function at least generally as described above. The blank can also be laminated to or coated with one or more sheet-like materials at selected panels or panel sections.

For purposes of the description presented herein, the term "line of disruption" can be used to generally refer to, for example, cut lines, slits, score lines, crease lines, tear lines, fold lines, and combinations thereof, formed in a blank.

A fold line can be any substantially linear, although not necessarily straight, form of disruption or weakening in the blank that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various combinations of these features.

The above embodiment may be described as having one or panels adhered together by glue. The term "glue" is intended to encompass all manner of adhesives commonly used to secure various portions of the blank.

The description is not intended to limit the invention to the form disclosed herein. Also, it is intended that the appended claims be construed to include alternative embodiments, not explicitly defined in the detailed description.

What is claimed is:

1. A package, comprising:

a carton, comprising:

at least one top panel;

a first receiving panel extending across a bottom of the carton;

a second receiving panel extending across the bottom of the carton;

a first side panel;

a second side panel;

a brace extending between the first and second receiving panels, the brace comprising a first side brace panel foldably connected to the first receiving panel, a second side brace panel foldably connected to the second receiving panel, and a center brace panel foldably connected to the first side brace panel and the second side brace panel and extending across the top of the brace;

a first row of first container apertures in the first receiving panel, at least one first strut being located at each first container aperture; and a second row of second container apertures in the second receiving panel and spaced from the first row of container apertures, at least one second strut being located at each second container aperture; and a plurality of containers, each container being accommodated in one of the container apertures and having a flange at the top of the container that comprises an upper end face at the top of the flange, a lower end face at the bottom of the flange, and an intermediate flange surface, extending between the upper end face and the lower and end face, the intermediate flange surface having an inner portion adjacent the brace and an outer portion adjacent one of the first side panel and the second side panel, wherein the brace extends between the first row of container apertures and the second row of container apertures and is adjacent to and abuts a respective flange of the plurality of containers, the center brace panel abuts and extends between the respective inner portions of the intermediate flange surfaces and is located at an elevation below the elevation of the upper end face of the flanges, and the first side panel and the second side panel abut the respective outer portions of the intermediate flange surfaces of the flanges, the center brace panel cooperating with a respective one of the first side panel and the second side panel to restrict each respective container from translational movement in a direction generally perpendicular to the first side panel and the second side panel.

2. The package of claim 1, wherein the first side brace panel is foldably connected to the first receiving panel at a first fold line and the second side brace panel is foldably connected to the second receiving panel at a second fold line.

3. The package of claim 2, wherein the brace has a triangular cross-sectional shape and the first and second side brace panels abut at a lower portion of the brace and extend generally upwardly from the lower portion of the brace to the center brace panel.

4. The package of claim 2, wherein the at least one first strut located at each first container aperture extends generally upwardly and contacts an underside of the flange of the container accommodated in an associated container aperture.

5. The package of claim 2, wherein each at least one first strut comprises a first inner strut and a first outer strut spaced from the first inner strut, each inner strut and each outer strut contacting an underside of one of the container flanges.

6. The package of claim 5, wherein the brace is adjacent to the inner struts.

7. The package of claim 1, wherein the carton has a substantially tubular shape with open ends.

8. A package, comprising:

a carton, comprising:

at least one top panel;

a first receiving panel extending across a bottom of the carton;

a second receiving panel extending across the bottom of the carton;

a first side panel;

a second side panel;

a brace comprising a first side brace panel foldably connected to the first receiving panel, a second side brace panel foldably connected to the second receiving panel, and a center brace panel foldably connected to the first side brace panel and the second side brace panel and extending across the top of the brace;

a first row of first container apertures in the first receiving panel; and a second row of second container apertures in the second receiving panel; and a plurality of containers, each container being accommodated in one of the container apertures so that the containers are arranged in the first and second rows, each container having a flange at the top of the container that comprises an upper end face at the top of the flange, a lower end face at the bottom of the flange, and an intermediate flange surface extending between the upper end face and the lower end face, the intermediate flange surface having an inner portion adjacent the brace and an outer portion adjacent one of the first side panel and the second side panel, wherein the brace extends generally upwardly from the first and second receiving panels between the first row of containers and the second row of containers, the center brace panel abuts and extends between the respective inner portions of the intermediate flange surfaces and is located at an elevation below the elevation of the upper end face of the flanges, and the first side panel and the second side panel abut the respective outer portions of the intermediate flange surfaces of the flanges, the center brace panel cooperating with a respective one of the first side panel and the second side panel to restrict each respective container from translational movement in a direction generally perpendicular to the first side panel and the second side panel.

9. The package of claim 8, wherein the first side brace panel is foldably connected to the first receiving panel at a first fold line and the second side brace panel is foldably connected to the second receiving panel at a second fold line.

10. The package of claim 9, wherein the brace has a triangular cross-sectional shape and the first and second side brace panels abut at a lower portion of the brace and extend generally upwardly from the lower portion of the brace to the center brace panel.

11. The package of claim 8, wherein the carton has a substantially tubular shape with open ends.

12. A carton blank for forming a package for holding a plurality of containers, each having a flange, the blank comprising:

at least one top panel;

a first side panel;

a first receiving panel foldably connected to the first side panel, the first receiving panel including a plurality of first receiving patterns;

a second side panel;

a second receiving panel foldably connected to the second side panel, the second receiving panel including a plurality of second receiving patterns; and a plurality of foldably connected brace panels disposed between the first and second receiving panels, the brace panels being positioned for contact with a respective flange of the plurality of containers, the brace panels comprising a first side brace panel foldably connected to the first receiving panel, a second side brace panel foldably connected to the second receiving panel, and a center brace panel foldably connected to the first side brace panel and the second side brace panel;

when the blank is formed into the package, the center brace panel being for abutting a respective inner portion of an intermediate flange surface of each of the flanges, the intermediate flange surface of each flange extending between an upper end face at the top of the flange and a lower end face at the bottom of the flange, and the first side panel and the second side panel being for abutting a respective outer portion of each of the intermediate flange surfaces of the flanges, the center brace panel cooperating with a respective one of the first side panel and the second side panel to restrict each respective container from translational movement in a direction generally perpendicular to the first side panel and the second side panel, in the package formed from the blank, the center brace panel is located at an elevation below an elevation of the upper end face of the flanges.

13. The carton blank of claim 12, wherein the first side brace panel is foldably connected to the first receiving panel at a first fold line and the second side brace panel is foldably connected to the second receiving panel at a second fold line.

14. The carton blank of claim 13, wherein the brace panels are generally rectangular and connected to one another at transverse fold lines.

15. The carton blank of claim 13, wherein each receiving pattern defines a strut pair.

16. The carton blank of claim 15, wherein each strut pair comprises an inner strut and an outer strut.

17. A method of constructing a package, comprising:

providing a carton blank comprising:

at least one top panel;

a first side panel;

a first receiving panel foldably connected to the first side panel, the first receiving panel including a plurality of first receiving patterns;

a second side panel;

a second receiving panel foldably connected to the second side panel, the second receiving panel including a plurality of second receiving patterns; and a plurality of foldably connected brace panels disposed between the first and second receiving panels, wherein the plurality of brace panels comprises a first side brace panel foldably connected to the first receiving panel, a second side brace panel foldably connected to the second receiving panel, and a center brace panel foldably connected to the first side brace panel and the second side brace panel;

advancing a container through each receiving pattern, each container having a flange comprising an upper end face at the top of the flange, a lower end face at the bottom of the flange, and an intermediate flange surface extending between the upper end face and the lower end face, the intermediate flange surface having an inner portion adjacent the brace and an outer portion adjacent one of the first side panel and the second side panel;

moving the first and second receiving panels toward one another, thereby causing the first and second side brace panels to pivot upwardly and the center brace panel to abut the respective inner portion of the intermediate flange surface of each flange and extend between adjacent flanges;

positioning the first side panel and the second side panel to abut respective outer portions of the intermediate flange surfaces of the flanges, the center brace panel cooperating with a respective one of the first side panel and the second side panel to restrict each respective container from translational movement in a direction generally perpendicular to the first side panel and the second side panel; and closing a top of the package with the at least one top panel, in the closed package the center brace Danel is located at an elevation below an elevation of the upper end face of the flanges.

18. A method of constructing a package, comprising:

providing a carton blank comprising:

at least one top panel;

a first side panel;

a first receiving panel foldably connected to the first side panel, the first receiving panel including a plurality of first receiving patterns;

a second side panel;

a second receiving panel foldably connected to the second side panel, the second receiving panel including a plurality of second receiving patterns; and a plurality of foldably connected brace panels disposed between the first and second receiving panels, wherein the plurality of brace panels comprises a first side brace panel foldably connected to the first receiving panel, a second side brace panel foldably connected to the second receiving panel, and a center brace panel foldably connected to the first side brace panel and the second side brace panel;

advancing a container through each receiving pattern, wherein the containers are arranged in a first row and a second row, each container having a flange at the top of the container that comprises an upper end face at the top of the flange, a lower end face at the bottom of the flange, and an intermediate flange surface extending between the upper end face and the lower end face, the intermediate flange surface having an inner portion adjacent the brace and an outer portion adjacent one of the first side panel and the second side panel;

folding the first and second side brace panels with respect to one another so that the first and second side brace panels move out of plane with the first and second receiving panels and the center brace panel abuts and extends between the respective inner portions of the intermediate flange surfaces of respective flanges;

positioning the first side panel and the second side panel to abut respective outer portion of the intermediate flange surfaces of the flanges, the center brace panel cooperating with a respective one of the first side panel and the second side panel to restrict each respective container from translational movement in a direction generally perpendicular to the first side panel and the second side panel, and closing a top of the package with the at least one top panel, in the closed package, the center brace panel is located at an elevation below an elevation of the upper end face of the flange.

19. The package of claim 1, wherein the brace exerts a first biasing force against the inner portion of the intermediate flange surface of a respective flange and one of the first side panel and the second side panel exerts a second biasing force against the outer portion of the intermediate flange surface of a respective flange, the first biasing force and second biasing force being in opposite directions so as to restrain the containers in the carton.

20. The package of claim 1 wherein the flange is a lid of the container and the upper end face comprises a top axial end surface of the lid and the lower end face comprises a bottom axial end surface of the lid.

21. The package of claim 1, wherein the first side panel is continuous and free of openings.

22. The package of claim 1, wherein the center brace panel is connected to the first side brace panel at a first brace fold line that abuts the respective inner portion of the radial surface of at least one of the flanges.

* * * * *